US010357058B1

(12) United States Patent
Contreras

(10) Patent No.: US 10,357,058 B1
(45) Date of Patent: Jul. 23, 2019

(54) BATTERY-OPERATED IGNITION SMOKING PIPE

(71) Applicant: Olga Contreras, Dania, FL (US)

(72) Inventor: Olga Contreras, Dania, FL (US)

( * ) Notice: Subject to any disclaimer, the term of this patent is extended or adjusted under 35 U.S.C. 154(b) by 408 days.

(21) Appl. No.: 15/362,825

(22) Filed: Nov. 29, 2016

(51) Int. Cl.
*A24F 47/00* (2006.01)
*A24F 3/00* (2006.01)
*F23Q 7/16* (2006.01)

(52) U.S. Cl.
CPC . *A24F 3/00* (2013.01); *F23Q 7/16* (2013.01)

(58) Field of Classification Search
CPC ..... A24F 47/00; A24F 47/002; A24F 47/004; A24F 47/006; A24F 47/008; A61M 15/06
See application file for complete search history.

(56) References Cited

U.S. PATENT DOCUMENTS 3,698,400 A * 10/1972 Tucker ..... A24F 3/00 131/185
3,882,876 A * 5/1975 Covington ..... A24F 3/00 131/185
4,219,032 A 8/1980 Tabatznik et al.
4,253,475 A 3/1981 Schreiber et al.
4,303,083 A * 12/1981 Burruss, Jr. ..... A61M 15/06 131/194
4,922,901 A * 5/1990 Brooks ..... A24F 47/006 128/202.27
D381,116 S 7/1997 Richards
7,490,613 B2 2/2009 Iordan
2010/0319716 A1 12/2010 Tao
2013/0087160 A1* 4/2013 Gherghe ..... A24F 1/00 131/329
2014/0048084 A1 2/2014 Ulloa
2016/0100628 A1* 4/2016 Garcia ..... A24F 5/00 131/328

* cited by examiner

*Primary Examiner* — Cynthia Szewczyk

(57) ABSTRACT

An battery-operated ignition smoking pipe including a replaceable nichrome wire within an indentation on an inner perimeter of a bowl of the pipe body, a fuel reservoir directly below and adjacent the interior cavity of the bowl, an ignition switch on a stem of a pipe body to selectively activate one of the nichrome wire and an amount of fuel within the fuel reservoir to combust an ignitable smoking substance, such as tobacco, contained within the bowl, and a filter disposed between the stem and the bowl. The present device permits one-handed ignition to combust the smoking substance.

2 Claims, 4 Drawing Sheets

BATTERY-OPERATED IGNITION SMOKING PIPE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of smoking pipes are known in the prior art. However, what is needed and what is provided herein is a battery-operated ignition smoking pipe which provides a replaceable nichrome wire disposed on an inner perimeter of a bowl of the pipe body, a fuel reservoir disposed directly below and directly adjacent to the bowl, an ignition switch disposed on a stem of a pipe body which selectively activates one of the nichrome wire and an amount of fuel within the fuel reservoir to combust an ignitable smoking substance, such as tobacco, disposed within the bowl, and a filter disposed between the stem and the bowl. The present device permits one-handed ignition to combust the smoking substance more easily and faster than is possible with manual ignition of a pipe without the nicrhome wire, the fuel reservoir, and the ignition switch. In addition, the filter reduces the amount of smoke, any tar present, and fine particles which would otherwise be inhaled during combustion of the smoking substance. The filter further reduces the harshness of the smoke produced when compared to a smoking pipe without a filter.

FIELD OF THE INVENTION

The present invention relates to smoking pipes, and more particularly, to a battery-operated ignition smoking pipe.

SUMMARY OF THE INVENTION

The general purpose of the present battery-operated ignition smoking pipe, described subsequently in greater detail, is to provide a battery-operated ignition smoking pipe which has many novel features that result in a battery-operated ignition smoking pipe which is not anticipated, rendered obvious, suggested, or even implied by prior art, either alone or in combination thereof. To accomplish this, the present battery-operated ignition smoking pipe includes a single construction pipe body having a stem, a bowl, a mouthpiece extending through the stem and in fluid communication with the bowl, and an outer wall of the stem and the bowl. The bowl has a top edge, a bottom end, an interior cavity defined by the top edge, the bottom end, and the outer wall of the bowl, as well as an inner perimeter of the interior cavity. A battery-operated ignition switch is disposed within the stem has an activation button disposed on the stem. A length of replaceable nichrome wire is removably disposed within a continuous indentation disposed along the inner perimeter proximal the top edge. A battery, disposed within the stem, is in operational communication with the ignition switch. A fuel reservoir, disposed directly below and directly adjacent to the bowl, is configured to contain an amount of fuel, such as lighter fluid, therein. A refill nozzle on the outer wall of the bowl adjacent the fuel reservoir, is in fluid communication with the fuel reservoir. An igniter wire is continuously disposed from the ignition switch, to the battery, and encircles the interior cavity. The igniter wire is in operational communication with the length of nichrome wire. The ignition switch is configured to activate the igniter wire and upon activation of the igniter wire, the igniter wire is configured to selectively activate the length of nichrome wire to ignite an ignitable smoking substance, such as tobacco, disposed within the interior cavity of the bowl and alternately directly ignite the amount of fuel within the fuel reservoir to combust the ignitable smoking substance disposed within the interior cavity of the bowl. The smoker, thus, has the option of igniting the smoking substance by placing the nichrome wire within the indentation or by placing the amount of fuel within the fuel reservoir through the refill nozzle followed by pressing the activation button of the ignition switch.

A filter, provided to reduce the amount of smoke, any tar present, and fine particles which would otherwise be inhaled during combustion of the smoking substance and to reduce the harshness of the smoke, is transversely disposed directly between the stem and the bowl. Thus has been broadly outlined the more important features of the present battery-operated ignition smoking pipe so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
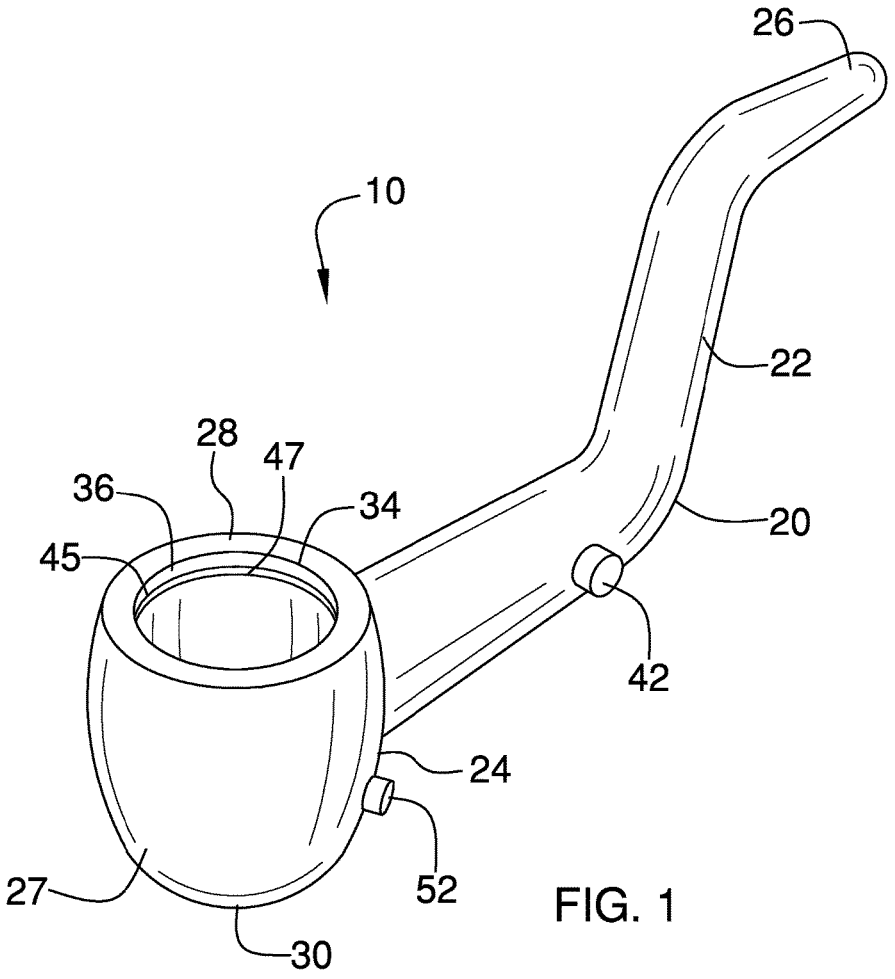
FIG. 1 is a front isometric view.
Figure 2:
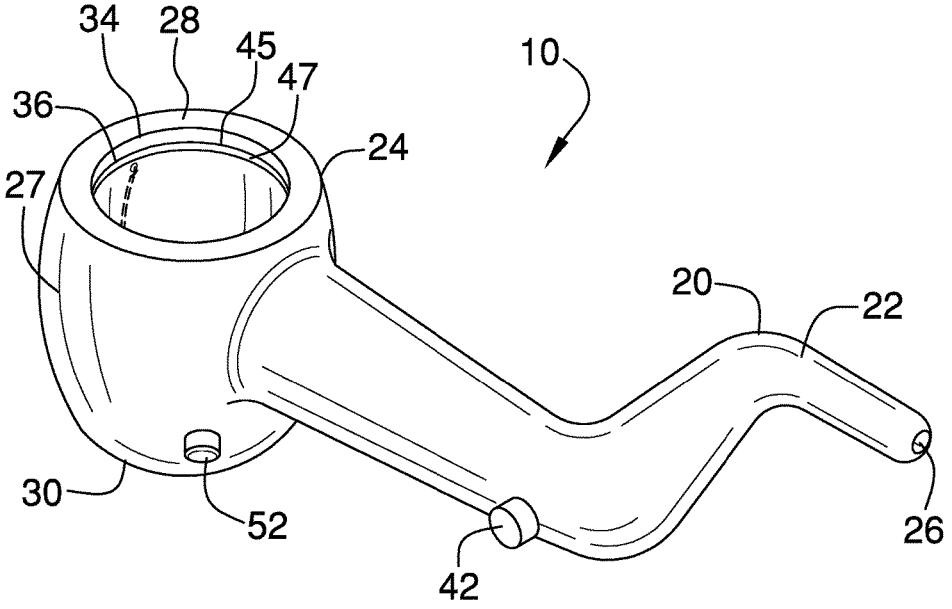
FIG. 2 is a rear isometric view.
Figure 3:
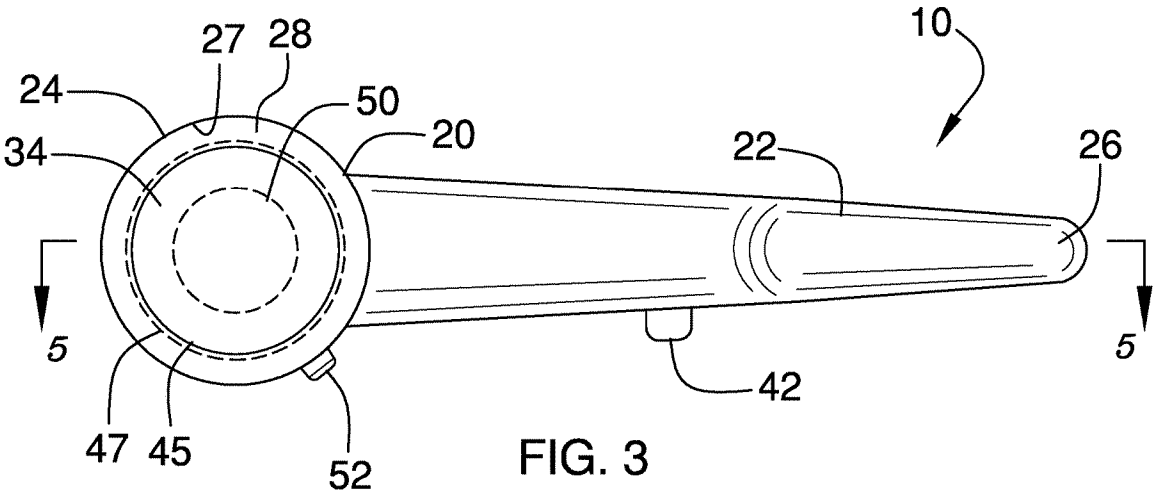
FIG. 3 is a top plan view.
Figure 4:
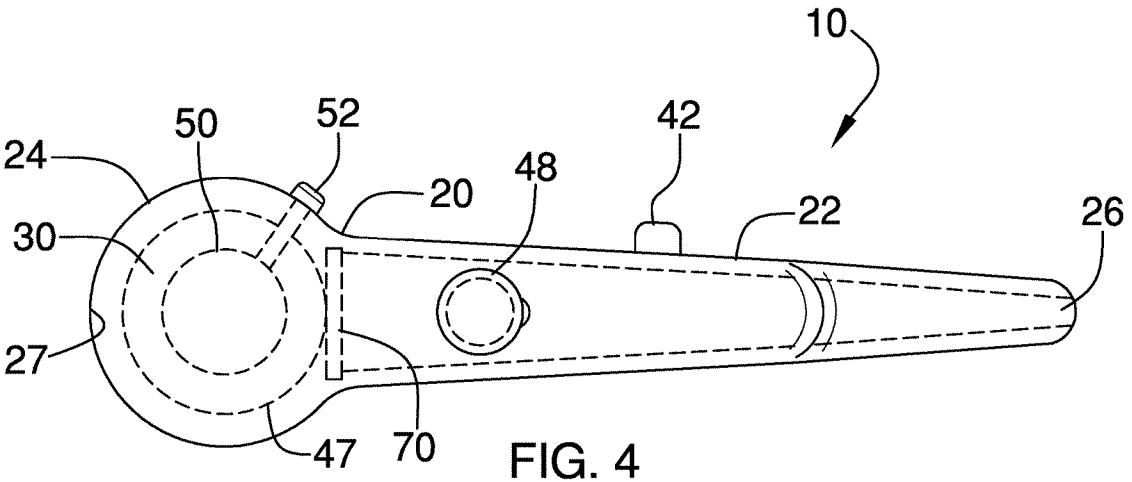
FIG. 4 is bottom plan view.
Figure 5:
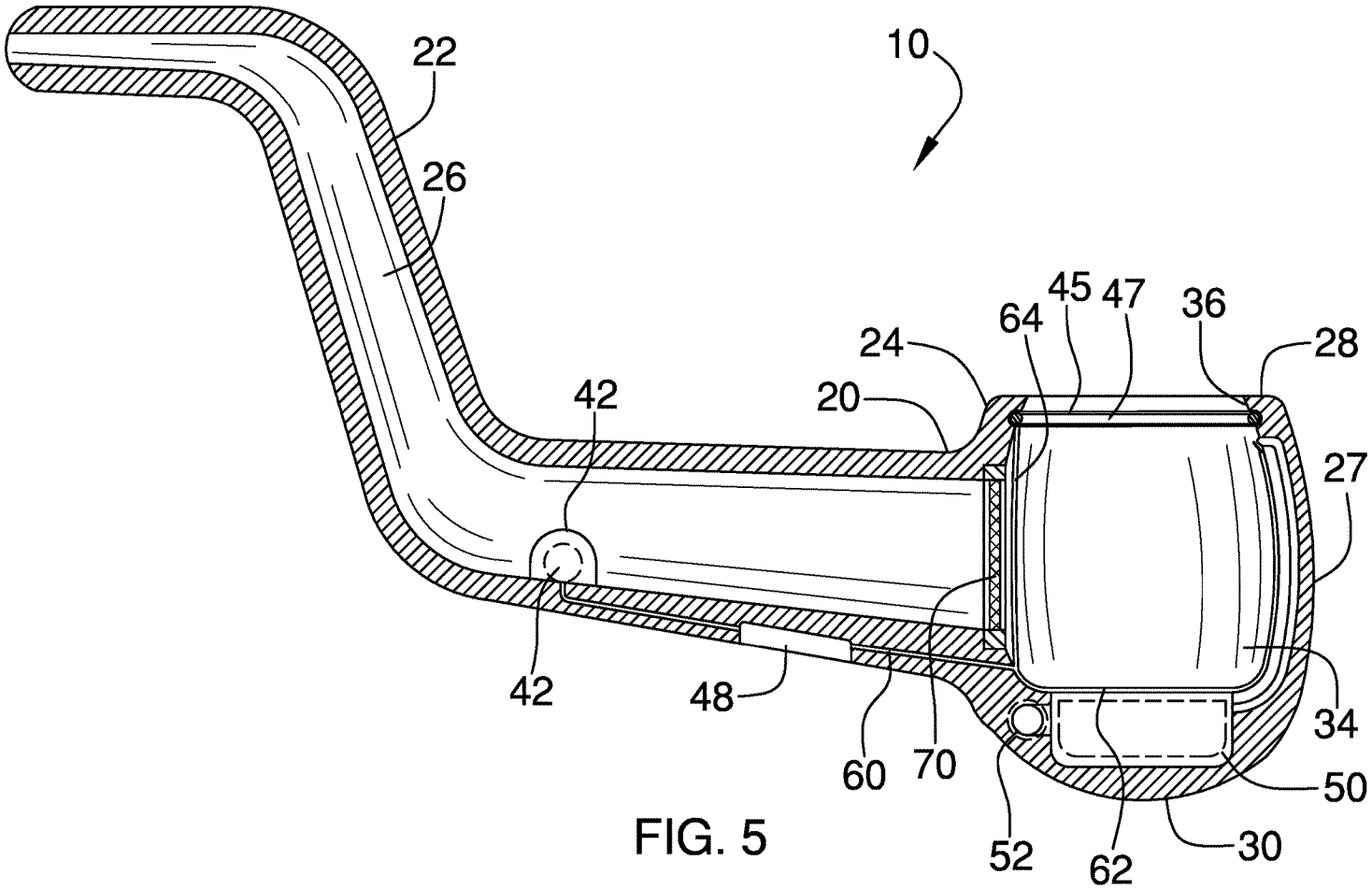
FIG. 5 is a cross-sectional view taken along line 5-5 of FIG. 3.

With reference now to the drawings, and in particular FIGS. 1 through 5 thereof, an example of the instant battery-operated ignition smoking pipe employing the principles and concepts of the present battery-operated ignition smoking pipe and generally designated by the reference number 10 will be described.

Referring to FIGS. 1 through 5 the present battery-operated ignition smoking pipe 10 is illustrated. The battery-operated ignition smoking pipe 10 includes a single construction pipe body 20. The pipe body 20 having a stem 22, a bowl 24, a mouthpiece 26 extending through the stem 22 and in fluid communication with the bowl 24, and an outer wall 27 of the stem 22 and the bowl 24. The bowl 24 has a top edge 28, a bottom end 30, an interior cavity 34 defined by the top edge 28, the bottom end 30, and the outer wall 27 of the bowl 24. The bowl 24 further includes an inner perimeter 36 of the interior cavity 34.

A battery-operated ignition switch 40 is disposed within the stem 22. The ignition switch 40 has an activation button 42 disposed on the stem 22. A continuous indentation 45 is disposed along the inner perimeter 34 proximal the top edge 28. A length of replaceable nichrome wire 47 is removably disposed within the indentation 45. A battery 48 is disposed within the stem 22 and is in operational communication with the ignition switch 40.

A fuel reservoir 50 is disposed directly below and directly adjacent to the interior cavity 34 of the bowl 24 proximal the bottom end 30. The fuel reservoir 50 is configured to contain an amount of fuel, such as lighter fluid, therein. A refill nozzle 52 is accessibly disposed on the outer wall 27 of the bowl 24 adjacent the fuel reservoir 50. The refill nozzle 52 is in fluid communication with the fuel reservoir 50.

An igniter wire 60 is continuously disposed from the ignition switch 40, to the battery 48, and encircles the interior cavity 34. A first portion 62 of the igniter wire 60 is disposed in a position between the fuel reservoir 50 and the interior cavity 34. A second portion 64 of the igniter wire 60 is disposed between the stem 22 and the interior cavity 34. The igniter wire 60 is in operational communication with the length of nichrome wire 47. The ignition switch 60 is configured to activate the igniter wire 60. Upon activation of the igniter wire 60, the igniter wire 60 is configured to selectively activate the length of nichrome wire 47 to ignite an ignitable smoking substance, such as tobacco, disposed within the interior cavity 34 of the bowl 24 and alternately directly ignite the amount of fuel within the fuel reservoir 50 to combust the ignitable smoking substance disposed within the interior cavity 60 of the bowl 24.

A filter 70 is transversely disposed directly between the stem 22 and the bowl 24. The second portion 64 of the igniter wire 60 is further disposed between the filter 70 and the interior cavity 34.

The smoker, thus, has the option of igniting the smoking substance within the interior cavity 34 by placing the nichrome wire 47 within the indentation 45 or by placing the amount of fuel within the fuel reservoir 50 through the refill nozzle 52 followed by pressing the activation button 42 of the ignition switch 40.

What is claimed is:

1. A battery-operated ignition smoking pipe comprising:

a single construction pipe body having a stem, a bowl, a mouthpiece extending through the stem and in fluid communication with the bowl, and an outer wall of the stem and the bowl, the bowl having a top edge, a bottom end, an interior cavity defined by the top edge, the bottom end, and the outer wall of the bowl, and an inner perimeter of the interior cavity;

a battery-operated ignition switch disposed within the stem, the ignition switch having an activation button disposed on the stem;

a continuous indentation along the inner perimeter proximal the top edge;

a length of replaceable nichrome wire removably disposed within the indentation;

a battery disposed within the stem, the battery being in operational communication with the ignition switch;

a fuel reservoir disposed directly below and directly adjacent to the interior cavity of the bowl proximal the bottom end, wherein the fuel reservoir is configured to contain an amount of fuel therein;

a refill nozzle accessible on the outer wall of the bowl in a position adjacent the fuel reservoir, the refill nozzle being in fluid communication with the fuel reservoir; and an igniter wire continuously disposed from the ignition switch, to the battery, encircling the interior cavity, a first portion of the igniter wire disposed in a position between the fuel reservoir and the interior cavity, a second portion of the igniter wire disposed between the stem and the interior cavity, the igniter wire being in operational communication with the length of nichrome wire;

wherein the ignition switch is configured to activate the igniter wire;

wherein upon activate of the igniter wire, the igniter wire is configured to selectively activate the length of nichrome wire to ignite an ignitable smoking substance disposed within the interior cavity of the bowl and alternately directly ignite the amount of fuel within the fuel reservoir to combust the ignitable smoking substance disposed within the interior cavity of the bowl.

2. The battery-operated ignition smoking pipe of claim 1 comprising:

a filter transversely disposed directly between the stem and the bowl;

wherein the second portion of the igniter wire disposed between the stem and the interior cavity is further disposed between the filter and the interior cavity.

* * * * *